US008794015B1

(12) United States Patent
Dahlen et al.

(10) Patent No.: US 8,794,015 B1
(45) Date of Patent: Aug. 5, 2014

(54) AIR TO LIQUID HEAT EXCHANGE SYSTEM FOR GROUND SOURCE HEAT PUMP SYSTEM

(75) Inventors: Derick O Dahlen, Minneapolis, MN (US); David A Boyles, Roseville, MN (US)

(73) Assignee: Avant Energy Inc., Minneapolis, MN (US)

( * ) Notice: Subject to any disclaimer, the term of this patent is extended or adjusted under 35 U.S.C. 154(b) by 286 days.

(21) Appl. No.: 13/452,308

(22) Filed: Apr. 20, 2012

(51) Int. Cl.
*F25B 7/00* (2006.01)

(52) U.S. Cl.
USPC ..... 62/79

(58) Field of Classification Search
USPC ..... 62/79, 260, 324.6
See application file for complete search history.

(56) References Cited

U.S. PATENT DOCUMENTS

| | | | | |
|---|---|---|---|---|
| 4,091,636 | A | 5/1978 | Margen | |
| 4,466,256 | A | 8/1984 | MacCracken | |
| 4,646,538 | A | 3/1987 | Blackshaw et al. | |
| 4,920,757 | A * | 5/1990 | Gazes et al. | 62/181 |
| 5,025,634 | A | 6/1991 | Dressler | |
| 5,239,838 | A | 8/1993 | Tressler | |
| 5,461,876 | A * | 10/1995 | Dressler | 62/160 |
| 5,671,608 | A | 9/1997 | Wiggs et al. | |
| 6,167,715 | B1 * | 1/2001 | Hebert | 62/260 |

FOREIGN PATENT DOCUMENTS

| | | |
|---|---|---|
| DE | 19950212 | 4/2001 |
| WO | 2006101404 | 9/2006 |

OTHER PUBLICATIONS

Data sheet for Alfa Laval Vantaa Fincoil Solar Junior G (downloaded Jan. 23, 2012).
Data sheet for Bell & Gossett Heat Exchanger (downloaded Feb. 9, 2012).
Data sheet for Viridian High Efficiency Pumps (downloaded Feb. 9, 2012).
Data sheet for MUT Corporate Motorized 2 and 3 Way Zone Valves—SF Series (downloaded Feb. 9, 2012).
Data sheet for Icma S.p.A. Valves (downloaded Feb. 9, 2012).
Data sheet for ClimateMaster Tranquility® 22 Digital Series (downloaded Feb. 9, 2012).
Data sheet for Reliable Controls® MACH-ProZone™ 2011 (downloaded Feb. 9, 2012).

* cited by examiner

*Primary Examiner* — Melvin Jones
(74) *Attorney, Agent, or Firm* — Dicke, Billig & Czaja, PLLC

(57) ABSTRACT

A heat exchange system with a glycol/water loop to exchange heat with ambient air, and a second glycol/water loop that is in a heat exchange relationship to the ground and a system of refrigerant based ground source heat pump (GSHP) systems. This provides an additional source of cooling or heating in lieu of the ground loop when ambient conditions dictate its use. An additional air/liquid heat exchanger is employed to exchange energy between the ambient air and the water/glycol mixture used in the conventional GSHP installation. Various sensors, one (or more) controller(s) and valves are employed to bypass the conventional ground source heat exchangers.

22 Claims, 4 Drawing Sheets

AIR TO LIQUID HEAT EXCHANGE SYSTEM FOR GROUND SOURCE HEAT PUMP SYSTEM

TECHNICAL FIELD

This application involves heat pump systems in which the ground is used as an energy source or sink, and one or more heat exchangers are used to improve performance of the systems throughout the year.

BACKGROUND

Ground source heat pump systems ("GHSP") have been demonstrated as an efficient means of delivering heating and cooling for the purpose of space conditioning for all types of residential, commercial and public buildings. These systems operate by making use of the relatively stable temperature of the ground as either a heat sink or heat source. A ground heat exchange system using a water/glycol mixture as the heat transfer medium is used to exchange heat with the refrigerant cycle contained in the heat pump. In the summer period the refrigerant cycle is used to remove heat from the space and discharge this heat to the ground using the same heat transfer medium and ground heat exchange system. In the winter heating period the same cycle is used to extract heat from the ground and deliver it to the building space using the same refrigerant cycle.

Historically the cost and performance of these types of GSHP are dependent on the temperature of the ground which is the ultimate source or sink for the heat, and the design heating or cooling load that the heat pump needs to deliver to the space. Because the ground temperature can vary throughout the year, both the efficiency and the capacity of the heat pump can vary as a result of ground temperature changes. Based on the geographic location of the heat pump installation there can be a significant difference between the total amount of heat extracted from the ground during the heating months and the amount of heat rejected to the ground in the cooling months. In climates where there is a significant imbalance between the summer cooling requirements heat rejection and the winter heating requirements heat extraction, this imbalance results in both a performance penalty for the heat pump system and a larger and more expensive ground heat exchange system.

Systems that extract more heat from the ground than they reject are called heating dominated systems, and systems that reject more heat to the ground than they extract are called cooling dominated systems. While geography and general climate are a major influence on whether a system is heating and cooling dominated, other factors such as building occupancy, solar loading, and other internal loads can also affect the characteristic of the system and thus the size of the ground loop required to meet the loads.

As GSHP systems have become more widespread it has become common practice to serve multiple heat pumps from the same ground heat exchange system. Since the presence of the ground heat exchanger limits the potential land use above it, there is an economic benefit to limiting the size of the ground heat exchange system from both an installed cost and land use perspective

SUMMARY OF THE DISCLOSURE

The invention solves the problems described above, by providing an additional source of cooling or heating in lieu of the ground loop when ambient conditions dictate its use. An additional air/liquid heat exchanger is employed to exchange energy between the ambient air and the water/glycol mixture used in the conventional GSHP installation. Various sensors, one (or more) controller(s) and valves are employed to bypass the conventional ground heat exchangers.

Thus, in one aspect, the invention is a method of assembling a ground source heat pump system, and in another aspect the invention is such an assembled system itself. In these aspects, a first heat exchanger loop uses a first water/glycol mixture to exchange heat between the heat pump system and at least one underground heat exchanger. An air/liquid heat exchanger exchanges heat between outdoor air and a primary side of a liquid/liquid heat exchanger; the secondary side of that heat exchanger is in a second heat exchanger loop, using a second water/glycol mixture. The two heat exchanger loops are interconnected such that either of them connects to the ground source heat pump system. A controller interconnected to each of the first and second heat exchanger loops selectively connects which of them is connected to the ground source heat pump. The controller does so as a function of at least: (1) heating/cooling season; (2) space temperature set point; and (3) whether ambient temperature exceeds ground temperature or vice versa.

In yet another aspect, the invention is a method of operating such a ground source heat pump system. Such operation is dictated by an operating algorithm, which algorithm could be considered by itself to be a fourth aspect of the invention. In general terms, the algorithm is a method of selectively connecting to a ground source heat pump system to a first ground heat exchanger loop having a first water/glycol mixture and a secondary side fluid loop having a second water/glycol mixture. Based on conventional inputs of temperature, date, location, and the like, the algorithm selects whether space conditioned by the ground source heat pump system is in heating or cooling season; whether there is a call for heating or cooling based on a conditioned space temperature set point; and whether ambient temperature exceeds ground temperature. Then, the algorithm decides among either: (1) supplying the ground source heat pump system with the air/liquid heat exchanger secondary side fluid loop if (a) there is a call for heating in heating season and ambient temperature exceeds ground temperature; or (b) there is a call for cooling in cooling season, and ground temperature exceeds ambient temperature; or (2) exchanging energy with the ground using the air/liquid heat exchanger secondary side fluid loop.

Controlling use of the ambient air to reheat the ground to offset the heat removed from the ground during the winter months reduces the amount of heat exchange surface required in the ground loop. This provides substantial savings in terms of initial construction costs and environmental impact. Also, the addition of an additional secondary heat exchange loop of a lower freezing point fluid prevents freezing in extreme weather conditions. The system allows the use of a single air heat exchanger in conjunction with multiple heat pumps connected to the same ground loop. Finally, the system takes advantage of the use of a programmable device to optimize performance over an entire heating season, based upon local weather data and operational characteristic of the loads being served.

Still further aspects are included in the specific, but non-limiting, examples described below and depicted by way of illustration only in the accompanying drawings.

BRIEF DESCRIPTION OF THE DRAWINGS

FIG. 1 illustrates heating or cooling mode using the ground as source or sink.

FIG. 2 illustrates heating or cooling mode using ambient air as source or sink.

FIG. 3 illustrates heating mode using ambient air to add heat to the ground.

FIG. 4 illustrates cooling mode using ambient air to remove heat from the ground.

DETAILED DESCRIPTION

Figure 1:
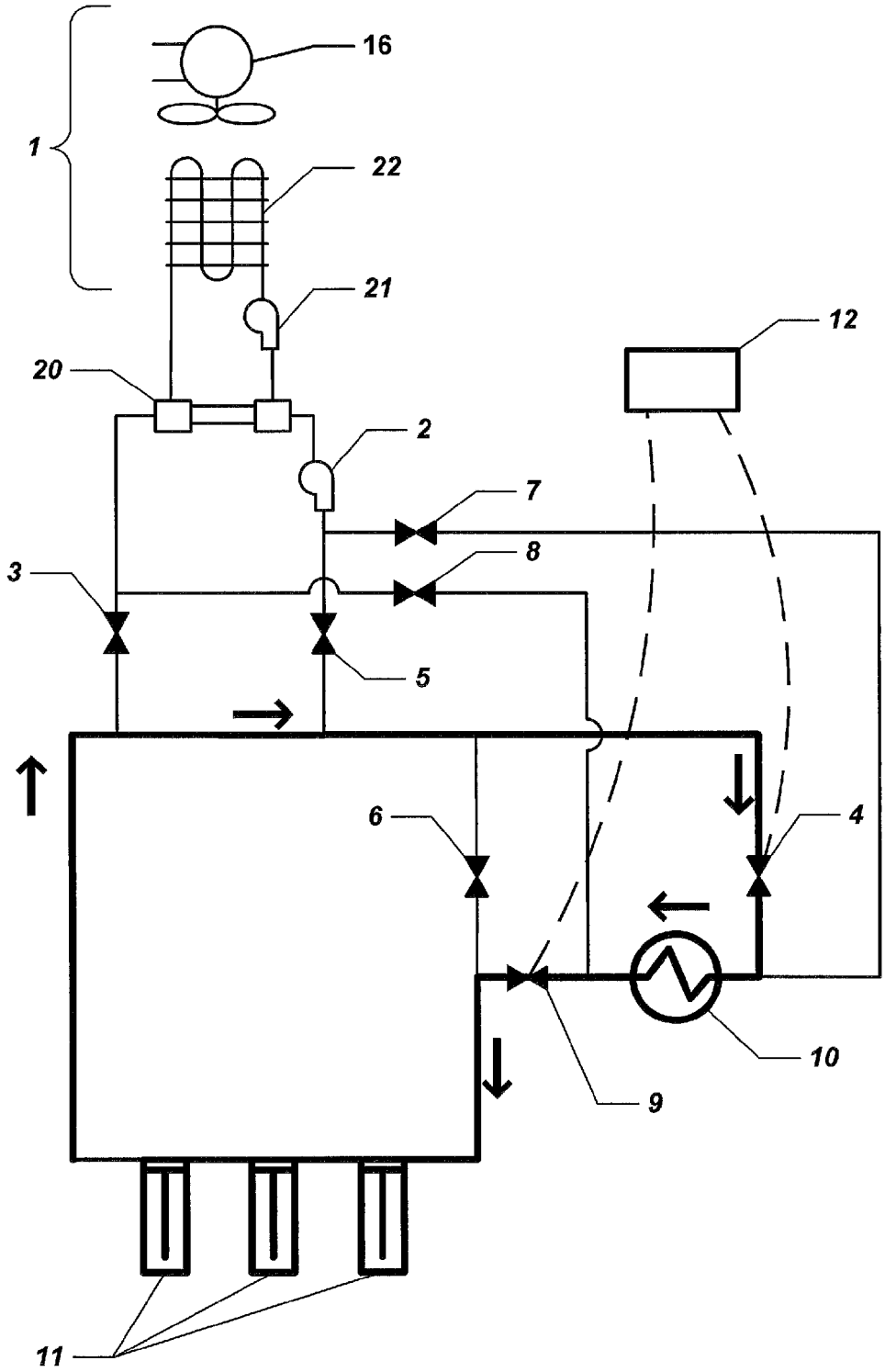
FIGS. 1-4 are like schematic diagrams illustrating different configurations appropriate for different times of year.

In general terms, the performance and cost of ground source heat pump systems can be improved by controlling the amount of heat that is either removed from or discharged to the ground over a heating and cooling season to meet a specific set of space conditioning requirements (either heating or cooling dominated). These improvements in cost and performance can be achieved by using the normal variation in ambient air temperature to offset the imbalance between the amount of heat exchanged with the ground during an annual heating and cooling cycle.

For a heating dominated system the additional heat exchange system will improve the performance of the GSHP system in two ways. First, during periods when the ambient air temperature is higher than the ground temperature and space heating is required, the heat exchange system would increase the temperature of the heating medium through the exchange of heat with the ambient air. Second, during high ambient air temperature periods prior to and during the heating season the additional heat exchanger would extract heat directly from the air and discharge it to the ground thus increasing the ground temperature adjacent to the ground loop.

This increase in ground temperature during the heating season will increase the capacity of the loop, and improve the performance of the ground source heat pumps connected to the loop. Because ground source heat pumps operate at small temperature differences between the ground and the conditioned space any increase in the average ground temperature will improve the performance of the heat pump in the heating mode over the heating season. The heat transferred to the ground in this mode of operation will in effect provide a thermal charge to the ground that can be extracted from the ground at times when the air to liquid heat exchanger is not operating. By supplying additional heat to the ground directly from the ambient air, the additional heat exchanger will also reduce the amount of heat exchange surface required to meet the maximum heating load for the entire system. This will reduce both the installation cost and the amount of land required to install the ground heat exchanger.

For a cooling dominated system the additional heat exchange system will also improve the performance of the GSHP system in two ways. First, during periods when the ambient air temperature is lower than the ground temperature and space cooling is required, the heat exchange system would decrease the temperature of the heating medium through the exchange of heat with the ambient air. Second, during low ambient air temperature periods prior to and during the cooling season the additional heat exchanger would transfer heat directly from the ground and discharge it to the air thus decreasing the ground temperature adjacent to the ground loop.

This decrease in ground temperature during the cooling season will increase the performance and capacity of the Ground Source Heat Pumps connected to the loop. Again, because ground source heat pumps operate at small temperature differences between the ground and the conditioned space any decrease in the average ground temperature will improve the performance of the heat pump in the cooling mode over the cooling season. The cooling transferred to the ground in this mode of operation will in effect provide a cooling charge to the ground that can be provided to the cooling loop at times when the air to liquid heat exchanger is not operating. By supplying additional cooling to the ground directly from the ambient air, the additional heat exchanger will also reduce the amount of heat exchange surface required to meet the maximum cooling load for the entire system. This will reduce both the installation cost and the amount of land required to install the ground heat exchanger.

A programmable controller that can sense both the ambient (outside) air temperature and the temperature of the water returning from the ground will control the operation of the ambient air heat exchanger to determine if the heat transfer is to either the heat pump or the ground, based on whether or not there is a call for heating or cooling from the heat pump.

The modes of operation of the ambient heat exchanger (air loop), the ground heat exchanger (ground loop) and the heat pump are summarized in Tables 1 and 2 based on the ambient conditions that exist at any time. Such modes may be implemented with a variety of equipment configurations. In general, for a preferred implementation, an ambient air heat exchange system is connected to the ground heat exchange system, e.g., through a liquid/liquid heat exchanger, using a booster pump to circulate the heat transfer medium through the ambient heat exchange system and back to the ground heat exchange system. Thus, the ambient air heat exchange system includes an extended surface liquid to air heat exchanger, typically using a fan to direct the movement of ambient air across the extended surfaces of the heat exchanger to increase the flow of heat between the ambient air and the heat transfer medium. Such a system would also include a control system and temperature sensors to monitor both the ground water leaving temperature and the ambient temperature. The control system would then automatically control the operation of the air/liquid heat exchanger pump and fan based upon the temperature sensors that monitor the ambient air and ground water leaving temperature.

Preferred embodiments are schematically illustrated with respect to FIGS. 1-4. FIG. 1 is a schematic representation of the ground source heating mode but will be used to describe components which do not operate in this mode. For example, in this mode the ambient air to liquid heat exchanger 1 is isolated from the ground loop using valves 3 and 5, which are closed in this mode (as are valves 7 and 8). Valves 4 and 9 are open to connect the ground heat exchanger (or multiple ground heat exchangers) 11 to the heat pump 10.

A programmable controller 12 senses both the ambient (outside) air temperature and the temperature of the liquid returning from the ground (or "ground temperature" in Tables 1 and 2 below). Such inputs are provided by conventional sensors omitted from each of FIGS. 1-4 only for clarity. Furthermore, for monitoring and other purposes, if desired the programmable controller could sense fluid temperatures, flow rates, and similar parameters at other locations in the system, again using conventional sensors, transmission lines or networks, and the like.

The ambient air to liquid heat exchanger 1 may be an integrated system which includes both an air/liquid heat exchanger 22 and a fan 16, i.e., a commercially available fan-coil unit, or it may be assembled from separate components. Regardless, programmable controller 12 prevents operation of the ambient air/liquid heat exchanger 1 in this mode by turning off fan 16 and booster pump 21 along with opening the valves 4, 9 specifically shown in the figure as connected to the programmable controller 12 by dashed lines and closing the other valves as noted above (thus the control lines to those closed valves are omitted for clarity only). This is done based on the heating load and ground heat transfer required as described above.

It is very much preferred that heat pump 10 be a conventional off-the-shelf unit requiring no internal modification. Such units conventionally include a pump (which is not shown for simplicity) as an integral feature (even if a pump is provided as a physically separate "flow unit"). The water/glycol mixture in the "ground loop" circulates by action of this pump, clockwise (as illustrated), which flow direction is typical for each of FIGS. 1-4.

The water/glycol mixture in the ground loop will typically be approximately 15% propylene glycol and 85% water, although a glycol percentage in the range of 0% to 50% is possible.

Heat pump 10 will operate according to its conventional operating sequence by a thermostat conventionally provided with it (or separately provided and installed with it), according to whatever settings are appropriate for comfort in the conditioned space.

Figure 2:
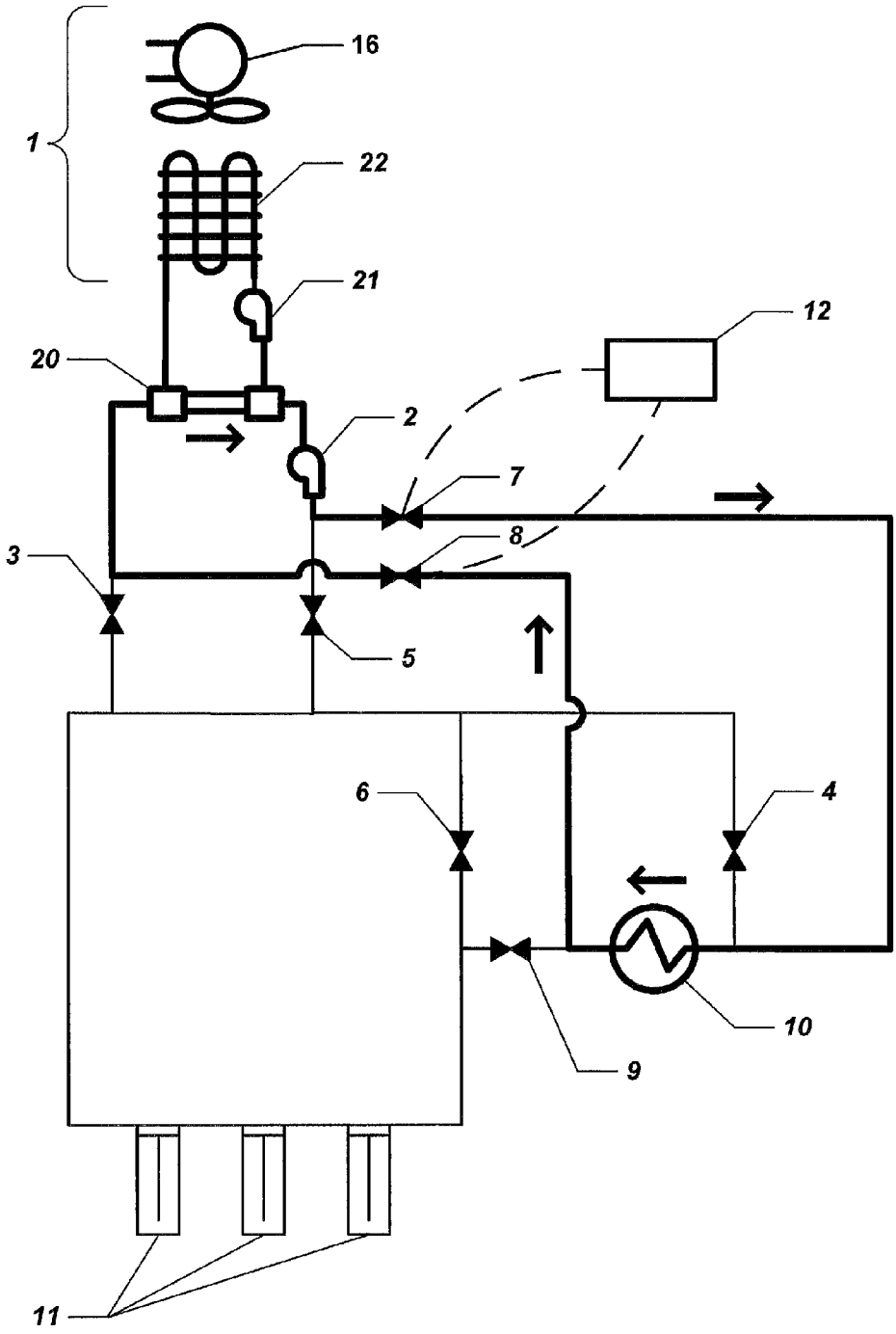

FIG. 2 is schematic representation of the air source heating mode. In this configuration the air to liquid heat exchanger 1 is connected to the heat pump 10 using valves 7 and 8. Valves 4 and 9 are closed to isolate the ground heat exchangers 11 from the heat pump 10. Valves 3 and 5 are also closed. A programmable controller 12 shown in the figure opens valves 7 and 8 shown in the figure based on the heating, cooling and ambient air heat transfer required as described above. All other valves remain closed.

Heat pump 10 will continues to operate according to its conventional operating sequence by its a thermostat. The source for heat pump 10 continues to be the glycol/water liquid formerly circulating through ground heat exchangers 11, but such liquid now circulates (by action of circulating pump 2) through the secondary side of liquid/liquid heat exchanger 20, i.e., by operation of air/liquid heat exchanger 1, outside air is used as a heat source instead of the ground.

The water/glycol mixture in the air loop will typically be approximately 45% propylene glycol and 65% water, although a glycol percentage in the range of 20% to 80% is possible.

Figure 3:
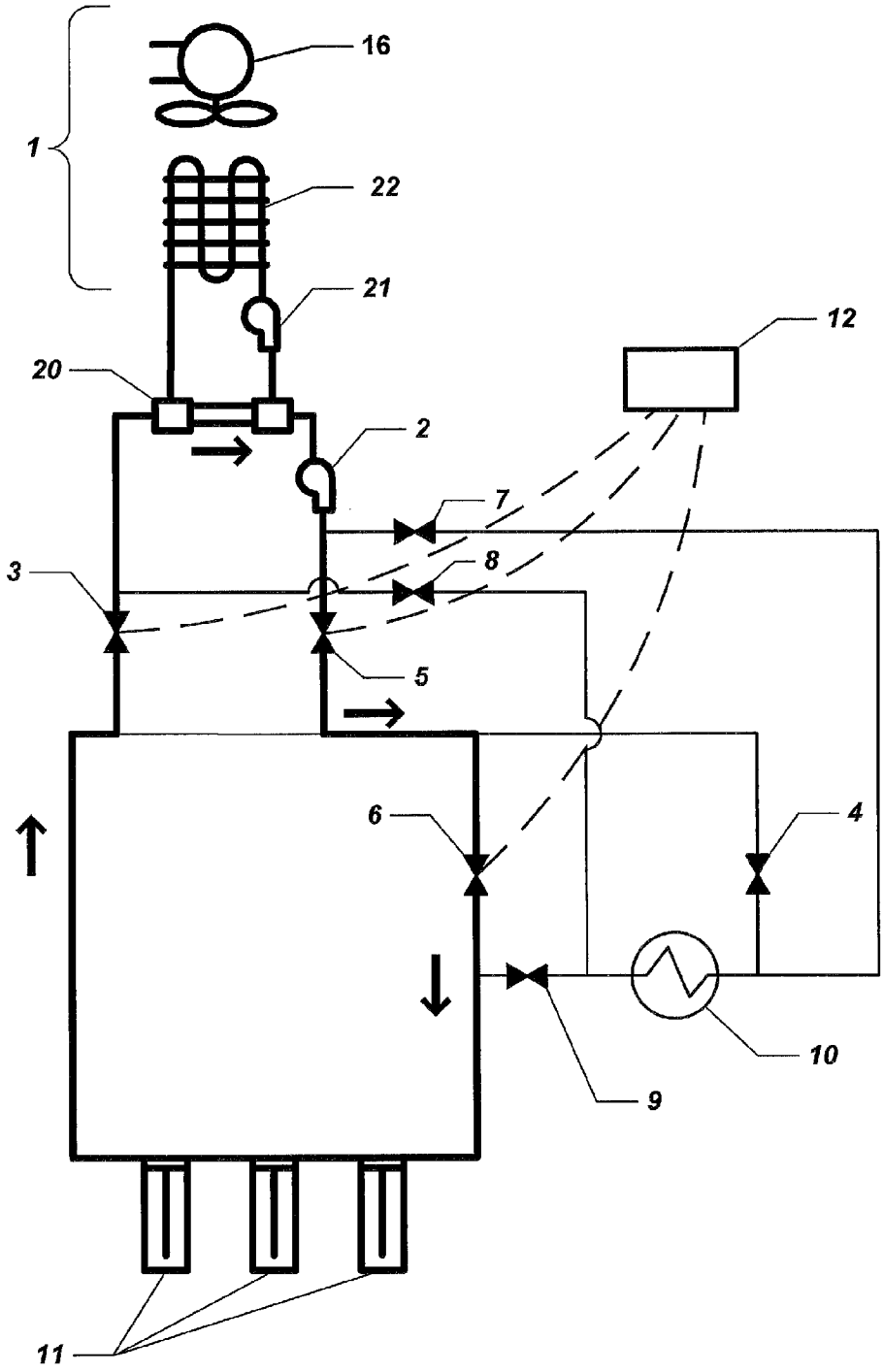

FIG. 3 is a schematic representation of the ground heating mode. In this configuration the programmable controller 12 determines that air to liquid heat exchanger 1 can be used to transfer heat from the air to the ground to recharge (heat) the ground source, while bypassing the heat pump. Thus, valves 3, 5 and 6 are open and circulation pump 2 is active to allow flow in the ground loop to bypass the heat pump 10. Valves 4 and 9 are closed to isolate the ground heat exchangers 11 from the heat pump 10 and valves 7 and 8 are closed to isolate the heat pump 10 from the air/liquid heat exchanger 1.

Figure 4:
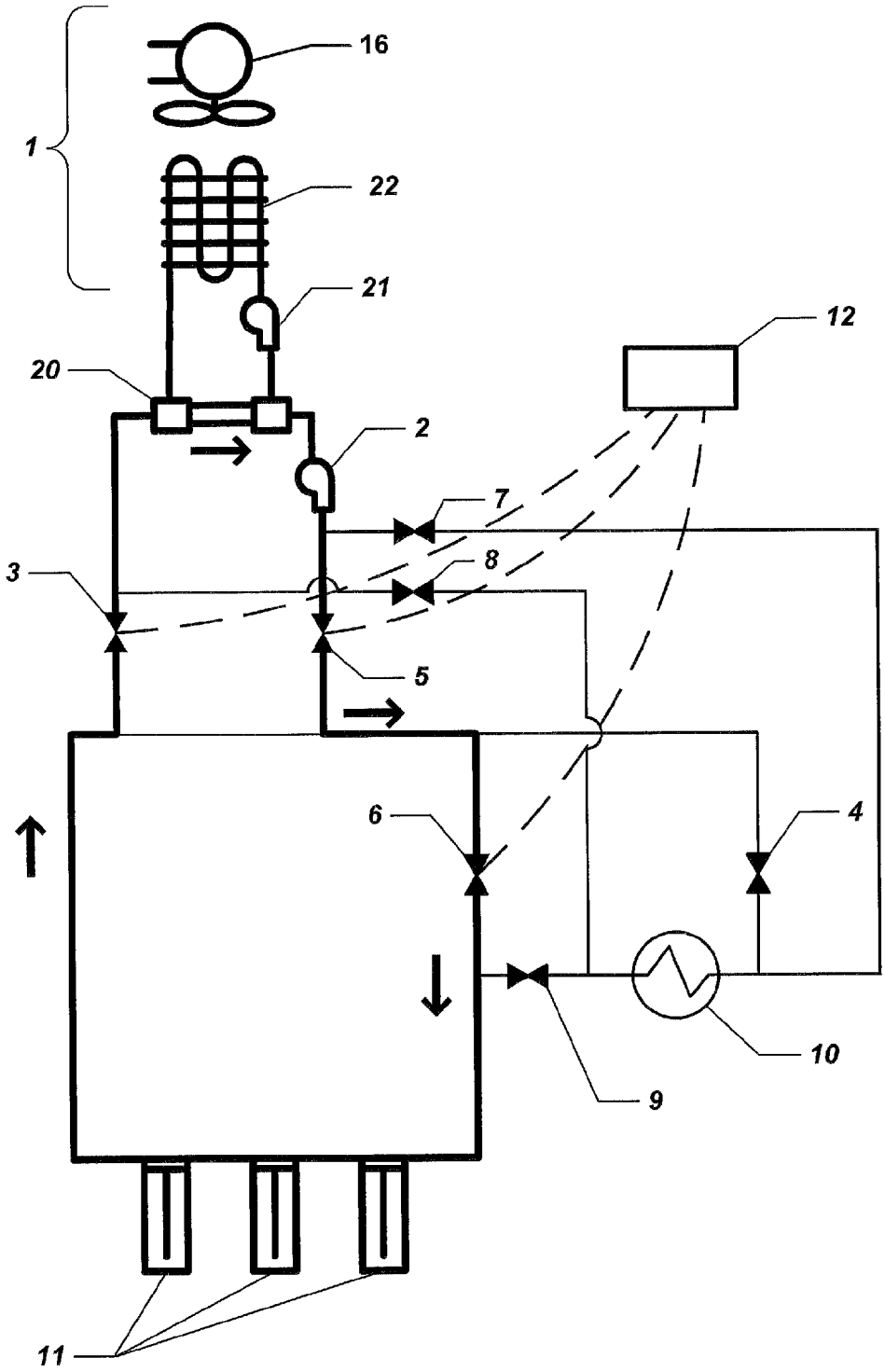

FIG. 4 is a schematic representation of the ground cooling mode. Again, programmable controller 12 controls the air to liquid heat exchanger 1 by turning on fan 16 and booster pump 21, connecting the liquid side of heat exchanger 1 (through liquid/liquid heat exchanger 20) to the ground heat exchangers 11 using valves 3, 5 and 6 and circulation pump 2; valves 7 and 8 are closed to isolate the ground heat exchangers 11 from the heat pump 10; and valves 7 and 8 are closed to isolate the heat pump 10 from the secondary side of liquid/liquid heat exchanger 20 and thus from air/liquid heat exchanger 1. This mode allows for heat to be transferred from the ground to the air to decrease the temperature of the ground.

Tables 1 and 2 below illustrate the high-level operating sequence that may be programmed into a controller for operation of the system as described above. The heating enhancement or cooling enhancement mode is selected based on parameters such as calendar date, for example. In each mode, a set point determines if there is a call for the operation of the system. For example, during the heating mode a space temperature set point determines if there is a call for heating, i.e., the conditioned space air temperature (inside air temperature) is lower than the set point (perhaps by a minimum amount, i.e., a dead band is employed), then the system will select which loop, air or ground, supplies the heat pump based on the "Ambient Condition." The term Ambient Condition could represent the collection of one or more conditions depending on the design of the system (which, of course, depends on the prevailing climate, location, and other factors which determine the heating and cooling loads for which the system is designed). For example, as illustrated by way of example only in Tables 1 and 2, the Ambient Condition could be the outdoor (ambient) air temperature as compared to the ground water return temperature. If the outdoor air temperature exceeds the ground water return temperature—again, a dead band approach may be employed if desired—then the ground water loop is a suitable source of cooling and the controller will select that loop to supply the heat pump. But if the outdoor air temperature is less than the ground water return temperature, the ambient outdoor air is the better source of cooling, and therefore the controller will select the air loop to supply the heat pump. In either case, the appropriate set of valves and fans will be activated or deactivated as required. An analogous result applies to the heating mode.

In both modes, when there is not a call for heating or cooling (as the case may be), the Ambient Condition criterion (or set of criteria) determine(s) whether to use the air loop to transfer energy from the air into the ground though the ground heat exchange loop, bypassing the heat pump (which is inactive). If the Ambient Condition does not warrant such transfer, both loops are inactive.

TABLE 1

| Heating Season | | |
|---|---|---|
| Ambient Condition | Thermostat Signal | System Configuration |
| Air Temperature Greater Than Ground Temperature | No Call (Thermostat Satisfied) | Air Loop Recharges Ground Loop |
| | Call for Cooling | Ground Loop Supplies Heat Pump |
| | Call for Heating | Air Loop Supplies Heat Pump |
| Air Temperature Less Than Ground Temperature | No Call (Thermostat Satisfied) | All Loops Inactive |
| | Call for Cooling | Air Loop Supplies Heat Pump |
| | Call for Heating | Ground Loop Supplies Heat Pump |

TABLE 2

| Cooling Season | | |
|---|---|---|
| Ambient Condition | Thermostat Signal | System Configuration |
| Air Temperature Greater Than Ground Temperature | No Call (Thermostat Satisfied) | All Loops Inactive |
| | Call for Cooling | Ground Loop Supplies Heat Pump |
| | Call for Heating | Air Loop Supplies |

TABLE 2-continued

| Cooling Season | | |
|---|---|---|
| Ambient Condition | Thermostat Signal | System Configuration |
| Air Temperature Less Than Ground Temperature | No Call (Thermostat Satisfied) | Heat Pump Air Loop Recharges Ground Loop |
| | Call for Cooling | Air Loop Supplies Heat Pump |
| | Call for Heating | Ground Loop Supplies Heat Pump |

EXAMPLE

An example of the system described above may be implemented according to the following general design parameters.

| Component | Potential Supplier and Model | Reference Number |
|---|---|---|
| Air/Liquid Heat Exchanger Fan Coil | Alfa Laval Fincoil SOLAR Junior G | 1, 16 |
| Plate Heat Exchanger | Bell and Gossett BP400-20-LCA | 20 |
| Booster Pump | Bell and Gossett Taco Varidian | 21 |
| Circulating Pump | Bell and Gossett Taco, Inc. Varidian VR series | 2 |
| Valves | ICMA art 300 series valve MUT Mechanical Series SF zone valve | 3-9 |
| Heat Pump | ClimateMaster Tranquility 22 Digital Series water source heat pump, 5-10 ton | 10 |
| Ground Heat Exchanger | 1 inch HDPE SDR 11 | 11 |
| Programmable Controller | Reliable Controls MACH-Prozone | 12 |

Alternative Embodiments

A plurality of heat pumps connected in parallel may be provided in place of the single heat pump 10 illustrated in the Figures even if only a single air/liquid heat exchanger 1 is used. The heat pumps may or may not be identically sized and would be independently controlled by their own thermostats. This would be applicable, for example, in multi-unit housing such as twin- or quad-homes or apartment buildings. Thus, unless specified to the contrary, reference to a single heat pump should be understood as including a plurality of heat pumps; this is especially true in the claims that follow below.

It may be desirable to employ a fail-safe device (or program) to prevent freezing of the ground loop, by automatically bypassing the air heat exchanger when conditions warrant.

The description above contemplates that at least one of the heat exchanger loops, but not both, connects to the ground source heat pump, but if design conditions so warrant, both loops could connect to the ground source heat pump. This would require, for example, that the water/glycol ratios of the fluids in each loop be the same; or that required isolation and purging valves/piping be provided to prevent the two fluids from cross-contaminating each other; or otherwise as dictated by the design conditions.

Construction

Unless disclosed and claimed otherwise, the construction of the system follows standard design criteria and parameters suitable for the installation of ground source heat pump systems, including compliance with local codes.

It should be understood that references in the drawings or their accompanying written description may refer to fluid "lines" or similar terms which are used to refer to not only the piping or lines themselves, but also the associated fittings and the like that would be understood by the person of ordinary skill in the art of piping design to be desirable, necessary, or included for any purpose, even if not specifically stated. For example, check valves, pressure sensors, traps, etc. that are not critical to the scope of the invention may be omitted from the drawings or description for purposes of clarity, even if such items would be employed in commercial embodiments of the invention. There are no limitations on the scope of the invention, except as described in the following claims. In particular, the following claims may use the language "first," "second," "third," and so on to specifically distinguish between various elements that are otherwise similarly named. These terms are not intended to imply any order of importance or time sequence in manufacturing or use, unless other claim language specifically does so.

We claim:

1. A method of assembling a ground source heat pump system, comprising:

a. providing a ground source heat pump system comprising at least one heat pump and a first heat exchanger loop using a first water/glycol mixture to exchange heat between each heat pump and at least one underground heat exchanger;

b. providing an air/liquid heat exchanger having an outdoor air primary side to exchange heat between outdoor air and a primary side of a liquid/liquid heat exchanger;

c. providing a second heat exchanger loop using a second water/glycol mixture on a secondary side of the liquid/liquid heat exchanger;

d. interconnecting the first heat exchanger loop and the second heat exchanger loop such that either of them connects to the ground source heat pump system; and e. providing a controller interconnected to each of the first and second heat exchanger loops to selectively connect which of them is connected to the ground source heat pump as a function of at least: (1) heating/cooling season; (2) space temperature set point; and (3) whether ambient temperature exceeds ground temperature or vice versa.

2. The method of claim 1, further comprising providing a circulating pump connected to both of the first and second heat exchanger loops.

3. The method of claim 1, in which the first and second water/glycol mixtures are the same.

4. The method of claim 1, in which the first water/glycol mixture has a glycol percentage in the range of 0% to 50%.

5. The method of claim 1, in which the second water/glycol mixture has a glycol percentage in the range of 20% to 80%.

6. The method of claim 1, in which the air/liquid heat exchanger includes an integrated fan.

7. The method of claim 1, further comprising providing a booster pump on the outdoor air primary side of the air/liquid heat exchanger.

8. A ground source heat pump system, comprising:

a. a ground source heat pump system comprising a heat pump and a ground heat exchanger loop of a first water/glycol mixture connected between the heat pump and at least one underground heat exchanger;

b. an air/liquid heat exchanger having a primary side fluid loop and a secondary side fluid loop of a second water/glycol mixture;

c. selective interconnection of one of the first ground heat exchanger loop and the air/liquid heat exchanger secondary side fluid loop to the ground source heat pump; and d. a controller programmed to select which loop is connected to the ground source heat pump as a function of at least: (1) heating/cooling season; (2) space temperature set point; and (3) whether ambient temperature exceeds ground temperature or vice versa.

9. The system of claim 8, further comprising a circulating pump connected to both of the ground heat exchanger loop and air/liquid heat exchanger secondary side fluid loop.

10. The system of claim 8, in which the first and second water/glycol mixtures are the same.

11. The system of claim 8, in which the first water/glycol mixture has a glycol percentage in the range of 0% to 50%.

12. The system of claim 8, in which the second water/glycol mixture has a glycol percentage in the range of 20% to 80%.

13. The system of claim 8, in which the air/liquid heat exchanger includes an integrated fan.

14. The system of claim 8, further comprising a booster pump on the primary side of the air/liquid heat exchanger.

15. A method of operating a ground source heat pump system having: (a) a ground source heat pump system connected to at least one of a ground heat exchanger loop of a first water/glycol mixture and a secondary side fluid loop of a second water/glycol mixture; and (b) a second air/liquid heat exchanger having a primary side fluid loop, in which the first ground heat exchanger loop and the air/liquid heat exchanger secondary side fluid loop are interconnected such that either but not both is selectively connected to the ground source heat pump; the method comprising: selectively connecting which loop is connected to the ground source heat pump as a function of at least: (1) heating/cooling season; (2) space temperature set point; and (3) whether ambient temperature exceeds ground temperature or vice versa.

16. The method of claim 15, further comprising operating a circulating pump connected to both of the ground heat exchanger loop and the air/liquid heat exchanger secondary side fluid loop.

17. The method of claim 15, in which the first and second water/glycol mixtures are the same.

18. The method of claim 15, in which the first water/glycol mixture has a glycol percentage in the range of 0% to 50%.

19. The method of claim 15, in which the second water/glycol mixture has a glycol percentage in the range of 20% to 80%.

20. The method of claim 15, in which the air/liquid heat exchanger includes an integrated fan.

21. The method of claim 15, further comprising operating a booster pump on the primary side of the air/liquid heat exchanger.

22. A method of selectively connecting to a ground source heat pump system to a first ground heat exchanger loop having a first water/glycol mixture and a secondary side fluid loop having of second water/glycol mixture, comprising:

(a) selecting whether space conditioned by the ground source heat pump system is in heating or cooling season;

(b) determining whether there is a call for heating or cooling based on a conditioned space temperature set point;

(c) determining whether ambient temperature exceeds ground temperature; and (d) either:

(1) supplying the ground source heat pump system with the air/liquid heat exchanger secondary side fluid loop if there is a call for heating in heating season and ambient temperature exceeds ground temperature, or there is a call for cooling in cooling season, and ground temperature exceeds ambient temperature; or (2) exchanging energy with the ground using the air/liquid heat exchanger secondary side fluid loop.

* * * * *